United States Patent [19]

Johnson

[11] 4,311,206

[45] Jan. 19, 1982

[54] HEARING AID EAR MOLD WITH IMPROVED DISCRIMINATION

[76] Inventor: Rubein V. Johnson, 2432 Court, Muskogee, Okla. 74401

[21] Appl. No.: 81,669

[22] Filed: Oct. 4, 1979

Related U.S. Application Data

[63] Continuation of Ser. No. 905,726, May 15, 1978, abandoned.

[51] Int. Cl.[3] ..... H04R 25/02

[52] U.S. Cl. ..... 181/135; 179/1 E

[58] Field of Search ..... 181/129–137; 179/107 E, 107 R, 182 R

[56] References Cited

U.S. PATENT DOCUMENTS

| | | | |
|---|---|---|---|
| 2,377,739 | 6/1945 | Wyekoff | 181/132 |
| 3,047,089 | 7/1962 | Zwislocki | 181/135 |
| 3,080,011 | 3/1963 | Henderson | 181/135 |
| 3,126,977 | 3/1964 | McGee | 181/135 |
| 3,368,644 | 2/1968 | Henderson | 181/129 |
| 3,602,330 | 8/1971 | Johnson | 181/135 |
| 3,688,863 | 9/1972 | Johnson | 181/135 |
| 3,732,382 | 5/1973 | DeWitt | 181/130 |
| 4,010,820 | 3/1977 | Johnson | 181/135 |
| 4,069,400 | 1/1978 | Johnson et al. | 179/107 E |

*Primary Examiner*—L. T. Hix
*Assistant Examiner*—Benjamin R. Fuller
*Attorney, Agent, or Firm*—Head & Johnson

[57] ABSTRACT

An improved type of ear mold which is used with a hearing aid of conventional design, but is provided with an inner chamber, to which sound is communicated from the hearing aid through a plastic tube, and from which the sound is communicated to the inner ear, through a neck portion of the ear mold, into which is inserted a tubular metal insert of selected internal diameter and length, which communicates between the inner chamber and the inner ear. The volume of the inner chamber, in combination with the dimensions of the inner passage through the insert, defines an acoustic resonating system, which serves to accentuate selected frequencies which pass from the hearing aid into the ear mold.

1 Claim, 8 Drawing Figures

HEARING AID EAR MOLD WITH IMPROVED DISCRIMINATION

This is a continuation application of Ser. No. 905,726, filed May 15, 1978, now abandoned.

BACKGROUND OF THE INVENTION

1. Field of the Invention

This invention lies in the field of hearing aids. More particularly, it concerns the design of an ear mold for use with a conventional hearing aid. Still more particularly, it concerns an ear mold in which means are provided for accentuating, or resonating, selected frequencies, in the sounds which are passed from the hearing aid into the ear mold, and then into the inner ear of the user.

2. Description of the Prior Art

In the prior art it has been customary to provide a hearing aid with an outlet to which a small diameter plastic tubing is attached. The outlet of the plastic tubing enters the ear mold which generally is custom molded to fit the particular ear. The communicating tubing from the hearing aid is inserted into an opening in the ear mold and held in that position. There is a communicating opening through the ear mold down through the neck of the ear mold, of a diameter substantially the same as that of the small diameter tubing from the hearing aid.

In other words, the ear mold is something which is molded to the shape of the user's ear, primarily so that it will be held securely in the ear of the user's external auditory canal to transmit the sound wave front through the process of hearing to the inner ear and on to the brain for discrimination.

For information relating to improved ear molds for hearing aids, reference may be had to U.S. Pat. Nos. 3,921,756 and 4,010,820.

SUMMARY OF THE INVENTION

It is a primary object of this invention to provide an ear mold which is used in connection with a conventional hearing aid and is designed so that it has an inner chamber and outlet opening facing the eardrum, such that a resonance system is provided that will resonate at selected frequencies when acoustic energy is applied through the tubing from the hearing aid.

These and other objects are realized and the limitations of the prior art are overcome in this invention by providing a plastic molded ear mold, which differs from the conventional ear mold, in that it provides something more than a simple channel for acoustic energy to pass from the outlet of the hearing aid into the ear of the user.

The ear mold is a molded plastic device having an outer contour and volume which is adapted to fit within the convolutions of the external auditory canal of the ear of the user, and may extend out from the ear a selected distance. The ear mold is designed with an inner chamber of selected volume and geometric shape, which can be provided by slitting the ear mold into two parts, or by slitting off, or out, the section of the ear mold that will contain the orifice or port providing the entrance of the sound waves from the hearing aid and then drilling, routing the cavity, and subsequently reassembling the ear mold after the desired volume and geometric shape of the inner cavity has been achieved.

This subsequent reassembly of the ear mold requires no other technique than now presently employed by the various ear mold laboratories in building up or cementing together a broken ear mold.

Means are provided at the neck portion of the hearing aid which fits into the external auditory canal facing the eardrum of the user to provide a drilled opening of selected length and diameter for sound transmission to and through the eardrum. If desired, the opening can be enlarged and fitted with a tubular insert of selected material, length, and diameter. On the outer surfaces of the ear mold, plug means are provided for connecting the small diameter plastic tubing from the outlet of the hearing aid, to and through the outer wall of the ear mold, through which the plug is sealed. The acoustic energy passing through the tubing then passes into the inner chamber of the ear mold, which, in combination with the metal insert, provides a resonant cavity of a selected frequency response. Thus, the resonant chamber or Helmholtz resonator serves to amplify selected frequencies in the acoustic energy, moving into the resonant chamber, and through it, and through the insert, into the external auditory canal and then on through the middle and inner ear.

In many cases it may not be necessary to use the metal insert, and in such an event, the length and diameter of the neck opposite the eardrum may be drilled out to certain lengths and diameters which shall embrace a larger opening toward the inner volume or space and a smaller opening toward the eardrum to allow formation of a compressional sound wave.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
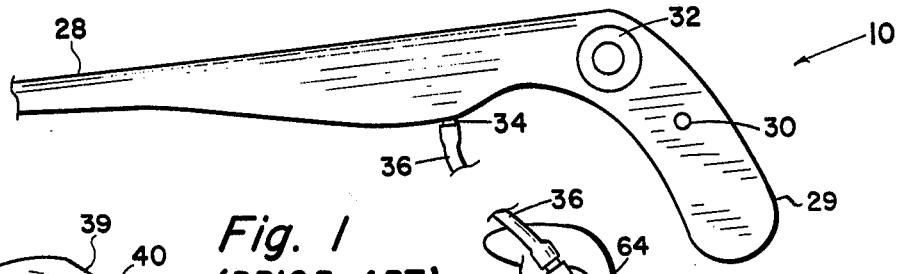
Fig. 1 (PRIOR ART)
FIGS. 1 and 2 represent prior art hearing aids.
Figure 2:
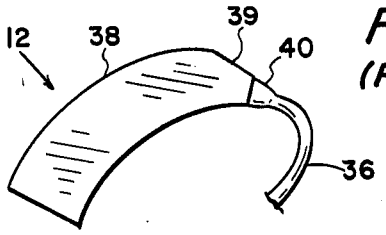
Fig. 2 (PRIOR ART)

Referring now to FIGS. 1 and 2, there are shown in simple outline, conventional hearing aid elements. FIG. 1 represents a commercial type of hearing aid which is housed in one of the arms of a spectacle frame, indicated generally by the numeral 10. This arm 28 has an enlarged portion 29 at its outer end, which includes the microphone, electronics, and output speaker. The microphone opening is indicated by numeral 30, the volume control by the numeral 32, and the acoustic outlet of the hearing aid is the stub tube 34.

Figure 3:
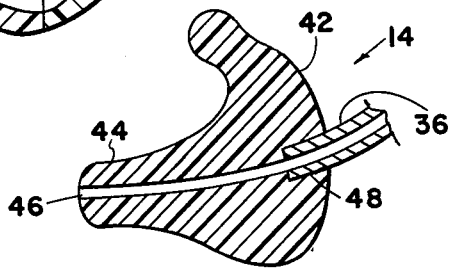
Fig. 3 (PRIOR ART)
FIG. 3 represents a prior art ear mold.

The acoustical output of the hearing aid is conveyed from 34 by means of a small diameter tubing 36, which is shown in FIG. 3 entering an opening 48 in the ear mold 42. There is an additional opening 46 through the ear mold, of a diameter substantially equal to that of the internal diameter of the tubing 36. The acoustic energy at the outlet 34 of the hearing aid, is conveyed down the tubing 36 and into the ear mold through the tubular openings 48 and 46, through the neck portion 44 of the ear mold, and thus into the external auditory canal of the user. FIGS. 1 and 3 indicate prior art.

Also illustrating the prior art is another type of hearing aid, indicated generally by the numeral 12 in FIG. 2. In this device the microphone, electronics, and output speaker are housed in the plastic case 38, which rests on top of the user's ear, and the acoustic energy output goes through the end 39 of the hearing aid, through a stub shaft 40 and through the tubing 36, to an ear mold such as that shown in FIG. 3.

Figure 4:
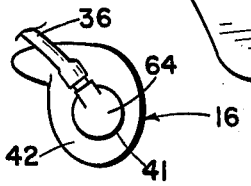
FIGS. 4, 5, 6, 7, and 8 represent exterior and cross-sectional views of a variety of ear molds of the improved design of this invention.

Shown in FIG. 4 is an outer view of an improved ear mold indicated generally by the numeral 16. This has a body 42 which has an opening 41 into which a plug 64 is inserted. The plug 64 has an internal passage and is connected by tubing 36, for example, to the outlet 34 of a hearing aid. The ear mold 16 could be attached to the tubing 36 of the ear above 12 indicated in FIG. 2.

Figure 5:
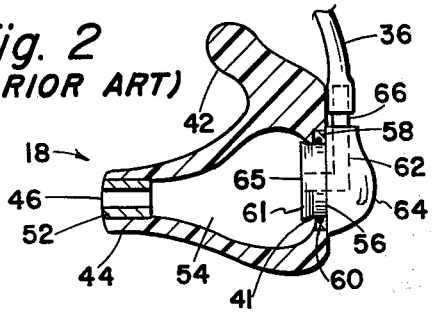

Referring now to FIG. 5, there is shown in cross-section one embodiment of this invention, namely, the ear mold indicated generally by the numeral 18. This has a body 42 which is shown schematically, but which would be custom molded to the contour of the ear of the user so that it will fit naturally and comfortably into the exterior auditory canal of the ear and will be held in place by the outer lips of the ear. Such ear molds are conventional, and this ear mold would be molded in a substantially similar manner, although, as will be explained, it must be constructed with an internal volume or chamber 54, which occupies a substantial or major portion of the internal volume of the ear mold.

All ear molds have a tapering neck portion 44 which is adapted to fit into the external auditory canal to a point close to but spaced from the eardrum. There is an opening 43 in the neck portion 44 into which may, or may not, be inserted an tubular insert 52, depending on the individual requirement, which fits snugly into the opening in the neck portion and which has a longitudinal or axial opening 46. The insert can be made of any selected material, such as plastic or metal. Gold is the preferred material.

The diameter and length of the axial opening 46 is important, since these dimensions, in conjunction with the inner volume 54, comprise a resonant system. Such resonant systems are well known, since they were taught many years ago by Helmholtz, who first suggested such types of acoustic resonators. Helmholtz pointed out the mathematical relationship between the volume of the cavity 54 and the length and diameter of the outlet of the chamber 46.

Reference is made to any textbook on acoustics. The resonance frequency is given by the relation $$fres = \frac{c}{2\pi} \sqrt{C/V}$$

where;

fres is the resonant frequency c is the velocity of sound in air

C is the acoustic conductivity of the opening in the insert; and

V is the volume of the inner chamber.

In this oscillating or resonating system, the air within the inner chamber comprises a capacitance, and the small volume of air in the opening 46 which is essentially a small plug of air equal in outer diameter to the inner diameter of the bushing or insert and equal in length approximately to the length of the opening through the bushing. Because of its rapid oscillatory motion within the opening of the bushing, this little plug of air acts as a mass, which, in conjunction with the capacitance of the volume 54, comprises an acoustic oscillation system. This can be tuned to a selected frequency and harmonics thereof. By selecting the dimensions of the cavity and the inserts, the resonance frequency can be shifted to any selected frequency, provided there is sufficient volume available, etc.

The use of a separate metal insert 52 makes it possible, by changing inserts, to change the frequency response of the resonator. If only a single frequency response is desired, the opening into which the insert is assembled can be designed to have the same dimensions as the openings 46.

Figure 6:
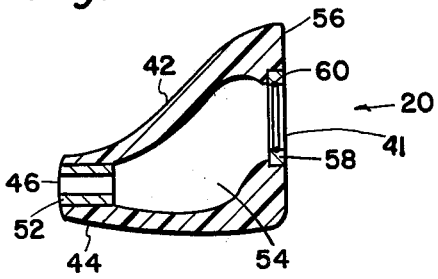
Figure 7:
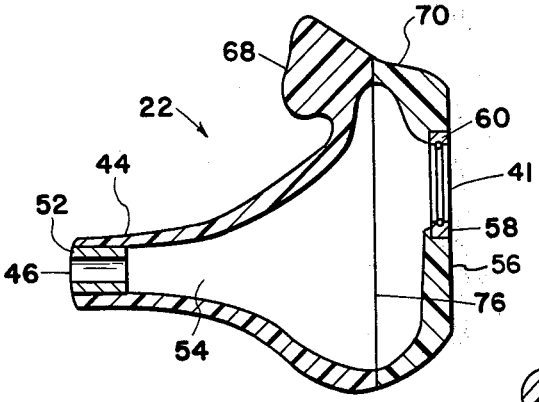
Figure 8:
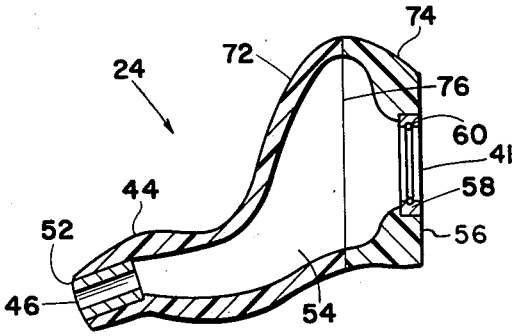

In FIGS. 6, 7, and 8, the ear molds have been shown with a flattened surface 56, and a metal or plastic ring 58 is inserted into the flat surface. The opening in the ring is provided with a seal means such as an O-ring 60. The plug 64 has a cylindrical extension 61 which is inserted to the opening through the ring 58, and which is sealed by the O-ring 60. There is a passage 62 cast into the plug 64, and this opening attaches to a tube 66 which fits into the tubing 36 which connects to the hearing aid. The passage 62 leads to the opening 65 into the chamber 54.

Ear molds of different sizes can be constructed with different inserts so that different ranges of frequencies can be accentuated. Each of these can be connected quickly to the plug 64 and tubing 36 so that the acoustical response of the ear mold, in relation to the hearing aid, can be altered.

FIGS. 5 and 6 illustrate molded ear molds in which the internal chamber 54 is molded in a single operation, as is well known in the art. FIGS. 7 and 8 are shown as being of larger total volume. FIGS. 7 and 8 show how the ear mold has been slit then drilled and routed out and reassembled. Each part is a relatively thin conical or cup-like shell. In FIG. 8 the two matching surfaces of the two parts 72 and 74 have been ground plane, then cemented together along the interface 76 to provide a unitary ear mold indicated generally by the numerals 24. In FIG. 7 the two parts are 68 and 70 of the ear mold 22.

It will be clear also that given a certain internal volume 54 that the frequency of the resonating chamber can be changed by providing an insert 46 of greater or lesser length, and of greater or lesser internal diameter. Because of the elastic nature of the molded plastic, such inserts 52 can be made in a variety of sizes and can be inserted or removed from the neck of the ear mold rather easily, and thereby changes in the resonance frequency of the acoustical system can be made.

What has been described is an improved type of ear mold which instead of being a passive mechanical device, serving only to hold the end of a tubing from the hearing aid to the inner ear in a fixed reproducible position, is now an active acoustical member of the system and can be tuned to selected frequencies, as desired, depending on the dimensions of the device.

From the description herein it can be seen that the insert 46 may be of metal or nonmetal, or it may be integrally formed of the same material as the ear mold itself. The ear mold can be routed or drilled out to provide the geometrical design of the cavity as required. The cavity in the ear mold provides a thin wall which affords some bone conduction of sound in the cavity to the ear bone structure, thus tending to improve the performance of the ear mold.

While the invention has been described with a certain degree of particularity, it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element thereof is entitled.

What is claimed is:

1. An improved ear mold for a hearing aid, comprising;

a plastic ear mold of selected outer shape and volume, said volume having a large diameter portion being the inlet end, and a neck portion adapted to fit into the ear of the user, being the outlet end;

said ear mold comprising an outer shell having an inner chamber utilizing a substantial major portion of the volume of said ear mold, a first opening in the inlet of said shell, and a second opening in the outlet end or neck portion of said shell;

tubular means to connect said first opening to an earphone, said second opening having a selected uniform inner diameter and selected length, whereby the volume of said inner chamber and the length and uniform inner diameter of said second opening comprise a resonating chamber of selected frequency; and a tubular insert of a selected metal inserted into said second opening in said neck portion, communicating with said inner chamber, the internal opening of said insert being of selected length and selected uniform diameter.

* * * * *